US005223214A

United States Patent [19]

Culling

[11] Patent Number: 5,223,214

[45] Date of Patent: Jun. 29, 1993

[54] HEAT TREATING FURNACE ALLOYS

[75] Inventor: John H. Culling, St. Louis, Mo.

[73] Assignee: Carondelet Foundry Company, St. Louis, Mo.

[21] Appl. No.: 911,145

[22] Filed: Jul. 9, 1992

[51] Int. Cl.[5] ..... C22C 38/34; C22C 30/00

[52] U.S. Cl. ..... 420/41; 420/51; 420/586.1

[58] Field of Search ..... 420/50, 51, 41, 586.1

[56] References Cited

U.S. PATENT DOCUMENTS 4,077,801 3/1978 Heyer et al. ..... 75/122
5,077,006 12/1991 Culling ..... 420/584.1

FOREIGN PATENT DOCUMENTS 50-102519 8/1975 Japan ..... 420/51
59-104458 6/1984 Japan ..... 420/50
1534926 12/1978 United Kingdom .

*Primary Examiner*—Deborah Yee
*Attorney, Agent, or Firm*—Senniger, Powers, Leavitt & Roedel

[57] ABSTRACT

Alloys are provided which consist essentially by weight percentages of from about 10.5% to about 28% Ni, from about 14.8% to about 23% Cr, from about 3% to about 6.6% Si, up to about 4% Al, from about 3% to about 6.6% total content of Si plus Al, from about 0.2% to about 4% Mn, from about 0.15% to about 1.6% Mo, from about 0.25% to about 1.25% W, from about 0.10% to about 0.75% Cb, from about 0.12% to about 1.2% C, from about 0.05% to about 0.45% Ti, and the balance essentially iron and the usual impurities. The alloys may optionally contain up to about 0.1% Ca, up to about 0.25% Zr, up to about 0.15% B, up to about 0.3% N and up to about 0.15% of rare earth components.

12 Claims, No Drawings

HEAT TREATING FURNACE ALLOYS

FIELD OF THE INVENTION

This invention relates to heat and corrosion resistant alloys suitable for use in heat treating fixtures, jugs and baskets to be employed in heat treating and waste incineration furnaces and like installations where such articles must possess high temperature strength and resistance to thermal fatigue, carburization, oxidation and sulfidation. The alloys are fully austenitic and can be air melted, wrought, cast, welded and readily formulated from common alloy scrap metal grades.

BACKGROUND OF THE INVENTION

There is a wide industrial demand for alloys capable of long service life in such forms as fixtures, trays, baskets and jigs that are exposed to carburization, oxidation and, possibly, sulfidation, in a variety of heat treating applications. They must often also resist thermal fatigue and thermal shock in applications where quenching is involved. These same properties are desireable in equipment for waste incineration, containers for baking carbon products, retorts and muffles, salt bath fixtures, radiant tubes and burners. Alloy cost is a significant factor, so that very high cost nickel and cobalt base alloys have extremely limited use for this kind of service even though many of them have excellent properties. In such applications required service temperatures are typically in the range of about 1550° to 1700° F. but may extend to as high as 2000° to 2100° F. in some applications.

The wrought form of 310 alloy and its cast equivalent, ACI type HK, have represented the lowest cost material generally suitable for such applications. Nominal composition and 10,000-hour rupture life at several temperatures for this alloy along with a few other alloys are given in Table I.

TABLE I

| | WEIGHT PERCENT NOMINAL COMPOSITION | | | | | STRESS FOR 10,000-HR RUPTURE LIFE, PSI | | |
|---|---|---|---|---|---|---|---|---|
| ALLOY | Fe | Ni | Cr | Si | Al | 1400° F. | 1600° F. | 1800° F. |
| 310(HK) | 53 | 20 | 25 | .5 | — | 4000 | 1200 | 540 |
| 330(HT) | 46 | 35 | 17 | 1 | — | 4300 | 1700 | 630 |
| 601 | 14 | 60 | 23 | .2 | 1.4 | 8000 | 3500 | 1400 |
| RA85H | 61 | 14.5 | 18.5 | 3.6 | 1 | 5200 | 2300 | 800 |
| HF20 | 67 | 12 | 19 | 1 | — | 6100 | 2700 | 1050 |

Alloy 330 and its cast equivalent, ACI type HT, offer some increase in hot strength and have been employed to a great extent in certain types of heat treating equipment.

Alloy 601 is essentially a wrought nickel-base alloy developed for this type of service. It may be seen from Table I that it offers considerable increase in hot strength but, due to its high nickel content, at substantially higher cost.

A recently developed wrought iron-base alloy of excellent properties and low cost has been marketed under the registered U.S. trademark, RA85H. It may be seen from Table I that this alloy offers hot strength somewhere between the iron-base alloys and the nickel-base 601 alloy at much lower critical element content than any of the other alloys.

Both silicon and aluminum serve as very low-cost, partial substitutes for chromium in developing resistance to oxidation and sulfidation. They both substantially enhance carburization resistance but also tend to reduce hot strengths of iron-base alloys significantly. For example, increasing silicon from 0.6% to 2.55% and aluminum from 0% to about 1% in iron-base alloys of about 31% Cr and 15% Ni contents reduces hot strengths at least 30% over the entire temperature range from 1200° to 2000° F. Another example of the effect of silicon and aluminum is seen in the comparison of the hot strength of alloy HF20 to that of alloy RA85H as shown in Table I. The former alloy is essentially the base alloy from which the RA85H was derived by increasing silicon content and adding aluminum but maintaining the same carbon level. Thus, while alloy RA85H has many other excellent properties, it suffers from a reduction in hot strength characteristics as compared to alloy HF-20.

It is well established that for long life at high stress and high temperature iron-base and nickel-base alloys must retain stable austenitic matrix crystal structures, that is, they must not form significant amounts of ferrite or sigma phase during the manufacture of products or in service. Therefore, the balance of proportions of austenite-forming to ferrite-forming elements must be carefully chosen. This balance is enormously complicated not only because the different concerned elements vary in their relative effects upon matrix structure but also because many of them may form certain compounds and therefore be removed in part or entirely from the matrix reaction.

The elements which favor the austenitic matrix structure are nickel, carbon, nitrogen, cobalt and copper. Those which favor ferritic or sigma phase structures include chromium, silicon, aluminum, molybdenum, tungsten, columbium, tantalum, titanium, zirconium and rare earth elements. Oxygen may even enter into the reaction in air melting practice, because certain of the elements may entirely or in part form stable oxides and thus be removed from the matrix.

Nickel does not form nitrides or carbides in any alloys and nickel-base super alloys do not contain any significant quantities of carbon or nitrogen. Rather, they derive their hot strengths principally by the formation and precipitation of compounds known as gamma prime, which are composed of nickel combined with titanium and/or aluminum. Contrariwise, low-nickel, iron-base alloys do not form gamma prime and depend principally upon the formation of carbides and, to a very much lesser extent, nitrides, to develop hot strength.

Aluminum forms nitrides and oxides, but no carbides, and is a powerful ferrite former and hot strength reducer when present in the matrix. Therefore, while aluminum may typically be present in nickel-base superalloys in amounts of about 1% to 6% as a strengthener, it is generally not employed in iron-base heat resistant alloys although it is sometimes used in tiny fractions of a percent as a deoxidizing element, if high hot strengths are required. Aluminum has been employed in amounts of about 2% to 15% in very low hot strength, ferritic, heat resistant alloys, but these are totally unrelated to the austenitic alloys discussed here.

Silicon forms oxides but no nitrides or carbides. It is a very powerful ferrite former and reduces hot strengths, as noted above. Silicon is most often employed in steel making practice as a deoxidizer in amounts, typically, of about 0.25% to 1%. While silicon has been employed in corrosion resistant alloys in larger amounts, most heat resistant alloy specifications set limits of 1% or 2% or, very infrequently, of 2.5% maximum.

Therefore, alloys of the RA85H type are metallurgically quite different from virtually all other heat resistant alloys, in that they contain large amounts of silicon, and, optionally aluminum. All other ferrite formers that are commonly employed in heat resistant alloys are also strong carbide formers. Many of them also form stable nitrides.

Small additions of two or more special elements have been made in recent decades to various iron-base heat resistant alloys in order to enhance their hot strengths and service lives. For example, U.S. Pat. No. 4,077,801 discloses the addition of combinations of tungsten and titanium or of tungsten, columbium and titanium to several grades of standard heat resistant alloys to improve hot strength. Further enhancement of the properties of the standard heat resistant alloys and similar alloys is described in U.S. Pat. No. 5,077,006 which discloses small additions of the six components molybdenum, tungsten, columbium, titanium, zirconium and one or more rare earth metals. A very important effect of such alloying additions is how they alter the form, solubility, location in the metallic body and tendency to coalesce of the carbides in the altered base alloy. Large total contents of such elements generally reduce elongation, toughness, machinability, weldability and resistance to thermal fatigue and shock. They also increase cost. Therefore, it remains desirable to find the best combination of elements in the lowest contents that will accomplish the desired results in each alloy type for each kind of application.

Also, British Patent No. 1,534,926 discloses high silicon content (4.1% to 12%), corrosion resistant alloys.

SUMMARY OF THE INVENTION

It is therefore an object of this invention to provide low cost, machinable, fabricable, weldable, castable alloys of very high hot strength suitable for long term use in heat treating fixtures, jigs and baskets, molten salt bath hangers, radiant tubes, combustion nozzles and fluidizing beds as well as in waste incineration and baked carbon products furnaces. An additional object is to provide alloys having excellent resistance to thermal fatigue and shock, and to oxidation, carburization and sulfidation at service temperatures as high as 2,000° to 2,200° F.

It is a further object to provide alloys of low strategic element contents, including relatively low nickel and chromium contents, which retain fully austenitic matrices over the service temperature range 1500° F. to 2200° F. and which may be readily formulated from ferroalloys, scraps and returns.

Furthermore, it is an object of this invention to provide a class of iron-base alloys which possess high temperature properties that clearly differentiate them from the iron-base and nickel-base alloys of the prior art, in that they are of much lower cost and critical element content then the latter and they provide superior hot strength combined with better carburization resistance than the former.

According to this invention alloys are provided which consist essentially by weight percentages of from about 10.5% to about 28% Ni, from about 14.8% to about 23% Cr, from about 3% to about 6.6% Si, up to about 4% Al, from about 3% to about 6.6% total content of Si plus Al, from about 0.2% to about 4% Mn, from about 0.15% to about 1.6% Mo, from about 0.25% to about 1.25% W, from about 0.10% to about 0.75% Cb, from about 0.12% to about 1.2% C, from about 0.05% to about 0.45% Ti, and the balance essentially iron and the usual impurities.

The alloys may optionally contain up to about 0.1% Ca, up to about 0.25% Zr, up to about 0.15% B, up to about 0.3% N and up to about 0.15% of rare earth components.

DETAILED DESCRIPTION OF THE INVENTION

The present invention is directed to austenitic, high hot strength heat resistant alloys of exceptional resistance to carburization, oxidation, sulfidation and thermal fatigue. Despite their low critical or strategic element contents the instant iron-base alloys provide long life, ductility, fabricability and weldability combined with levels of hot strength heretofore found only in nickel-base or much more costly alloys. They may be readily formed from ordinary ferroalloys and recycled scraps and returns and furnished in cast, forged and wrought forms.

The essential components of the alloys of the invention are:

| | |
|---|---|
| NICKEL | 10.5–28% BY WEIGHT |
| CHROMIUM | 14.8–23% |
| SILICON | 3–6.6% |
| ALUMINUM | 0–4% |
| SILICON PLUS ALUMINUM | 3–6.6% |
| MOLYBDENUM | 0.15–1.6% |
| TUNGSTEN | 0.25–1.25% |
| COLUMBIUM | 0.10–0.75% |
| TITANIUM | 0.05–0.45% |
| CARBON | 0.12–1.2% |
| MANGANESE | 0.2–4% |
| IRON | ESSENTIAL BALANCE |

Optionally the alloys of the invention may further contain

| | |
|---|---|
| CALCIUM | UP TO 0.1% BY WEIGHT |
| ZIRCONIUM | UP TO 0.25% |
| BORON | UP TO 0.1% |
| NITROGEN | UP TO 0.3% |
| RARE EARTH METALS | UP TO 0.15% |

Preferable alloys of the invention are those having elements in the following ranges of proportions:

| | |
|---|---|
| NICKEL | 10.5–22% BY WEIGHT |
| CHROMIUM | 14.8–22% |
| SILICON | 3–6.6% |
| ALUMINUM | 0–3% |
| SILICON PLUS ALUMINUM | 3.5–6.6% |
| MOLYBDENUM | 0.15–1% |
| TUNGSTEN | 0.25–1% |
| COLUMBIUM | 0.10–0.55% |
| TITANIUM | 0.05–0.35% |
| CARBON | 0.15–0.9% |
| MANGANESE | 0.5–4% |
| ZIRCONIUM | UP TO 0.2% |
| BORON | UP TO 0.1% |
| NITROGEN | UP TO 0.3% |
| RARE EARTHS | UP TO 0.15% |
| CALCIUM | UP TO 0.1% |
| IRON | ESSENTIALLY BALANCE |

For the best combination of room and elevated temperature properties providing long life and maximum resistance to quenching or thermal cycling, it has been found desirable to restrict the alloys of the invention to the following ranges of proportions:

| | |
|---|---|
| NICKEL | 10.5-16% BY WEIGHT |
| CHROMIUM | 14.8-20% |
| SILICON | 3-5.6% |
| ALUMINUM | 0-2% |
| SILICON + ALUMINUM | 4.4-5.6% |
| MOLYBDENUM | 0.18-0.55% |
| TUNGSTEN | 0.20-0.65% |
| COLUMBIUM | 0.20-0.40% |
| TITANIUM | 0.10-0.35% |
| CARBON | 0.15-0.35% |
| MANGANESE | 0.6-3.5% |
| ZIRCONIUM | UP TO 0.15% |
| BORON | UP TO 0.05% |
| NITROGEN | UP TO 0.15% |
| RARE EARTHS | UP TO 0.12% |
| CALCIUM | 0.002-0.1% |
| IRON | ESSENTIALLY BALANCE |

As the result of my investigations it has become apparent to me that no one combination of alloying elements is best for all alloy base types. Certain element combinations may enhance or reduce hot strength and other properties of a given alloy type, depending upon their various combinations and upon the carbon content of the alloy base type. Thus, since the alloys of the present invention derive their excellent hot strengths principally from the effects upon carbon of the relatively small amounts of the special addition elements, they must contain at least about 0.12% C to achieve hot strengths superior to those of alloy RA85H. On the other hand, while carbides and nitrides increase hot strength, they also form discontinuities in the metallic matrix that reduce fabricability and ductility. I have found that base alloys of the invention that are to be wrought and/or quenched in liquid media from high temperatures should contain less than about 0.35% C, preferably less than about 0.30%. In applications involving less drastic thermal cycling and no quenching in liquid media, castable alloys of the invention provide good machinability and weldability combined with very high hot strengths when carbon is present in the range of about 0.30% to 0.55%. If hot abrasion but no quenching or repeated drastic thermal cycling are to be encountered, cast alloys of the invention provide maximum hot strengths and hardnesses combined with fair machinability and weldability when carbon is present in the range of about 0.55% to 1.2%.

In iron base heat resistant alloys I have found that the optimum properties for quenching baskets and similar heat treating parts subject to repeated, drastic temperature changes are best achieved in the carbon content range of about 0.15% to about 0.35%. When less severe thermal cycling is involved, alloys of the invention maintain good weldability and machinability combined with higher hot strengths at carbon levels up to about 0.55%. Even though the alloys of the invention were developed mainly for severe thermal cycling service, high-carbon variations may contain up to as much as 1.2% C for relatively steady temperature applications while providing very high strengths with reasonable machinability. Alloys of the invention which contain carbon contents at the very high end of the allowable range will still retain stable austenitic matrices even at the very lowest end of the nickel range. The instant alloys, therefore, are very low-cost, carburization resistant alloys of very high hot strengths for service at temperatures up to 2000° to 2200° F. Nevertheless, the surprising properties of the alloys of the invention, including their remarkably high hot strengths, are achieved at small total contents of the special alloying elements molybdenum, tungsten, columbium, titanium and optionally, zirconium, boron, calcium and/or cerium or rare earths combined with relatively low carbon contents of about 0.15% to 0.35% in iron-base alloys.

In certain combinations of hot gases the presence of both silicon and aluminum in the alloys provide the best corrosion resistance, while silicon alone is quite effective in some other gases. The alloys of the invention may contain silicon plus from nil to a significant amount of aluminum. Thus, the present alloys, like alloy RA85H, differ principally from prior art alloys in containing substantial amounts of the ferrite-former, silicon, and, perhaps aluminum, neither of which is removed from the matrix in the form of carbides. These alloys form a very separate category from the families of standard iron-base or nickel-base heat resistant alloys of the prior art. The alloys of the present invention retain the carburization and corrosion resistance of the RA85H-type alloys but at much higher hot strengths.

While alloys of U.S. Pat. No. 5,077,006 contain zirconium in amounts up to 0.8%, it was found in alloys of the present invention that zirconium content must be limited to a maximum of about 0.25% and that larger amounts result in drastically reduced ductility, weldability and fabricability properties. Hot strengths also deteriorate. Similarly, while rare earth elements were favorably employed in the '006 patent alloys in larger amounts, it was found that in alloys of the invention a combined content of all rare earth elements up to about 0.12% often enhanced ductility, weldability and fabricability, but that combined contents exceeding about 0.15% often drastically reduced these properties. Calcium behaves similarly. Amounts of 0.002% to about 0.1% Ca may improve these same properties, whereas amounts exceeding about 0.15% seriously reduced them.

The following examples further illustrate the invention

EXAMPLE I

One hundred pound heats of several different alloys were prepared in accordance with the invention. Heats of several comparative alloys were also prepared. Each of the heats was air-melted in a 100 pound high frequency induction furnace. Well-risered standard ASTM test bar keel blocks were cast from each heat. The compositions of the alloys of the invention are set forth in Table II with the balance in each case being essentially iron. The compositions of the comparative alloys are set forth in Table III, the balance in each case also being essentially iron. Alloy numbers 1552C, 1553C and 1551C were based upon high silicon alloys disclosed in British Patent No. 1,534,926 except that about 0.2% C was added to each alloy in an attempt to develop some hot strength.

TABLE II

COMPOSITION BY WEIGHT PERCENTAGES OF ALLOYS OF THE INVENTION

| ALLOY NUMBER | C | Ni | Cr | Mn | Si | Al | Mo | W | Cb | Ti | Zr | B | Ca | Ce |
|---|---|---|---|---|---|---|---|---|---|---|---|---|---|---|
| H-899 | .22 | 22.1 | 17.7 | .66 | 3.52 | .42 | .18 | .57 | .38 | .11 | .04 | — | — | — |
| H-903 | .21 | 27.2 | 20.1 | .64 | 3.52 | .60 | .82 | 1.08 | .40 | .12 | .05 | .09 | — | — |
| H-942 | .40 | 16.0 | 19.0 | 1.05 | 3.53 | .91 | .55 | .51 | .31 | .22 | — | .012 | — | — |
| H-943 | .92 | 22.0 | 20.0 | .57 | 3.43 | .99 | 1.55 | 1.06 | .53 | .13 | — | .013 | — | — |
| H-944 | .25 | 16.7 | 19.3 | .94 | 3.42 | .97 | .26 | .48 | .31 | .26 | .04 | .003 | .05 | — |
| H-946 | .39 | 17.2 | 18.4 | 1.28 | 5.21 | .04 | .25 | .52 | .33 | .23 | .03 | — | .004 | .05 |
| H-947 | .31 | 16.7 | 18.5 | 3.52 | 3.09 | 1.55 | .26 | .47 | .26 | .21 | .05 | — | .07 | .06 |
| H-949 | .28 | 11.0 | 15.4 | 2.29 | 4.61 | .09 | .28 | .48 | .31 | .23 | — | — | — | — |
| H-951 | .28 | 20.1 | 20.6 | 1.15 | 3.58 | 1.57 | .36 | .36 | .22 | .25 | — | — | — | — |
| H-953 | .49 | 15.5 | 19.0 | 3.41 | 3.02 | 1.03 | .45 | .48 | .42 | .11 | .04 | .008 | — | — |
| H-954 | 1.03 | 16.3 | 21.8 | 3.48 | 3.09 | .86 | .66 | .53 | .38 | .13 | .03 | — | — | — |
| H-959 | .83 | 21.1 | 19.8 | 3.29 | 3.61 | 1.02 | .25 | .51 | .23 | .09 | .02 | — | — | — |
| H-960 | .22 | 16.2 | 18.4 | .89 | 3.57 | .96 | .31 | .38 | .34 | .23 | .03 | — | .06 | .06 |
| H-961 | .16 | 18.2 | 20.0 | .67 | 3.48 | .86 | .26 | .54 | .37 | .26 | .07 | .002 | .08 | — |
| H-962 | .20 | 17.3 | 18.9 | 1.08 | 3.52 | .77 | .31 | .38 | .33 | .28 | — | — | .03 | .04 |
| H-963 | .21 | 19.5 | 15.8 | 2.29 | 5.45 | .42 | .28 | .52 | .23 | .26 | — | — | — | — |
| H-964 | .25 | 12.9 | 15.2 | 2.31 | 4.62 | .21 | .26 | .40 | .29 | .22 | — | — | — | — |

TABLE III

COMPOSITION BY WEIGHT PERCENTAGES OF ALLOYS NOT OF THE INVENTION

| ALLOY NUMBER | C | Ni | Cr | Mn | Si | Al | Mo | W | Cb | Ti | Zr | B | Ca | Ce |
|---|---|---|---|---|---|---|---|---|---|---|---|---|---|---|
| 85H | .21 | 14.5 | 18.6 | .53 | 3.52 | 1.02 | — | — | — | — | — | — | — | — |
| 309 | .17 | 13.8 | 23.6 | .73 | .86 | — | — | — | — | — | — | — | — | — |
| 310 | .07 | 20.6 | 25.2 | .86 | .97 | — | — | — | — | — | — | — | — | — |
| 330 | .05 | 36.2 | 19.1 | .83 | 1.22 | — | — | — | — | — | — | — | — | — |
| H-945 | .37 | 16.6 | 15.8 | 2.28 | 7.47 | .04 | .32 | .51 | .22 | .24 | — | — | — | — |
| H-948 | .23 | 17.9 | 18.9 | 3.27 | 3.46 | .96 | .56 | .46 | .38 | .24 | .48 | .38 | — | — |
| H-950 | .21 | 16.7 | 19.2 | 1.06 | 3.54 | 1.25 | .26 | .28 | .27 | .23 | .28 | — | — | .16 |
| H-957 | .33 | 18.2 | 20.0 | .64 | 3.52 | .79 | .28 | .43 | .83 | .08 | .42 | .003 | .04 | — |
| H-958 | .23 | 18.0 | 19.8 | 1.02 | 3.57 | .88 | .28 | .46 | .23 | .54 | .48 | .002 | — | — |
| 1552C | .23 | 19.3 | 14.0 | .37 | 6.11 | .02 | 3.02 | — | — | — | — | — | — | — |
| 1553C | .22 | 19.0 | 18.1 | .53 | 3.89 | .94 | — | — | — | — | — | — | — | — |
| 1551C | .24 | 17.7 | 9.3 | .66 | 7.11 | — | — | — | — | — | — | — | — | — |

The alloy of Table III designated as 85H was formulated to provide a chemical composition substantially equivalent to that specified for the commercial wrought alloy produced under the trademark "RA85H". Stress rupture data for alloy 85H obtained during the testing of alloys of the invention were completely consistent with data obtained from published brochures of the alloy producer of alloy RA85H.

The 100 pound heat for each alloy provided eight test bars per alloy. One test bar from each heat was used to determine hardness values and provide material for other tests. The remaining seven test bars from each heat were used for elevated temperature stress rupture tests.

Room temperature mechanical properties were determined for alloys of the invention as well as for several comparative alloys. Tensile strength, yield strength, percent elongation and Brinell hardness for each alloy tested is set forth in Table IV. Properties for the comparative alloys are set forth below the dashed line. Alloys 85H, 309, 310 and 330 all have excellent room temperature ductility values but will be shown later to have poor to very poor hot strengths.

The comparative alloys H-945, H-958, H-950, H-957 and H-958 are similar to alloys of the invention but fall outside of the scope of the invention by reason of containing too much of one or more of the elements columbium, titanium, silicon, zirconium, boron or rare earth elements.

TABLE IV

ROOM TEMPERATURE MECHANICAL PROPERTIES

| ALLOY DESIGNATION | TENSILE STRENGTH PSI | YIELD STRENGTH PSI | % ELONGATION | BRINELL HARDNESS |
|---|---|---|---|---|
| H-961 | 90,300 | 42,700 | 41.5 | 176 |
| H-962 | 81,600 | 36,400 | 38.0 | 180 |
| H-960 | 88,900 | 40,200 | 36.5 | 179 |
| H-947 | 80,400 | 43,400 | 26.0 | 175 |
| H-944 | 79,100 | 38,700 | 21.5 | 178 |
| H-949 | 84,800 | 48,200 | 17.5 | 179 |
| H-964 | 79,100 | 47,800 | 16.5 | 180 |
| H-946 | 68,300 | 41,800 | 13.5 | 173 |
| H-963 | 68,100 | 42,600 | 9.5 | 175 |
| H-951 | 64,500 | 41,600 | 8.0 | 179 |
| H-942 | 63,100 | 39,900 | 7.5 | 179 |
| H-953 | 61,300 | 39,100 | 6.5 | 179 |
| H-899 | 54,300 | 30,300 | 6.0 | 179 |
| H-903 | 55,000 | 34,100 | 4.0 | 170 |
| H-943 | 68,400 | 40,900 | 4.0 | 207 |
| H-959 | 69,000 | 53,200 | 3.5 | 205 |
| H-954 | 66,900 | 61,300 | 1.5 | 258 |
| H-945 | 32,000 | 50,800 | 1.5 | 255 |
| H-948 | 54,400 | 48,600 | 1.0 | 179 |
| H-950 | 56,500 | 47,800 | 2.5 | 185 |
| H-957 | 55,100 | 34,200 | 4.0 | 180 |
| H-958 | 55,600 | 43,100 | 2.0 | 184 |
| 85H | 89,900 | 32,300 | 41.0 | 192 |
| 309 | 88,500 | 36,400 | 39.5 | 193 |
| 910 | 77,000 | 39,000 | 37.5 | 195 |
| 330 | 72,200 | 38,900 | 42.5 | 148 |
| 1552C | 39,800 | 38,900 | 2.5 | 118 |
| 1553C | 56,500 | 42,900 | 9.0 | 196 |
| 1551C | 73,100 | 58,600 | 0.5 | 302 |

Alloys of the invention are set forth above the dashed line of Table IV in order of descending tensile elongation values. Alloys in Table IV down through H-946 all have good room temperature elongation values. The first six alloys listed in the table contain small amounts of cerium and/or calcium as well as 0.36% or less carbon. Small amounts of zirconium or boron are also sometimes present in these six alloys.

Rare earth element additions were made to several of the alloys of the invention as well as alloy H-950, which is outside the invention, in the form of lumps of misch metal. The misch metal lot used in these experiments was composed of about one half cerium by weight and the balance principally lanthanum and other rare earth species. Only cerium content was determined by chemical analysis. Therefore, it was assumed that the total content of all rare earth elements would be approximately double the content determined for cerium in each case.

Alloy H-950 would thus probably contain about 0.32% total of all rare each elements. It is obvious from Table IV that alloy H-950 did not develop high elongation through use of the rare each element addition. As will be shown by the results of stress rupture tests, alloy H-950 also had poor rupture life. The other four comparative alloys, H-945, H-948, H-957 and H-958, also had low tensile elongations as well as poor stress rupture lives.

From the data of Table IV various conclusions can be drawn, as discussed below.

Alloys H-949 and H-964 contain no zirconium, boron, calcium or rare earth elements but still have good elongation values. They also contain relatively low amounts of nickel, chromium and aluminum, but higher amounts of silicon than the first five alloys of Table IV.

Alloy H-963 contains larger amounts of nickel and silicon than the above alloys and none of the group zirconium, boron, calcium and rare earths and has much lower elongation than the first eight alloys.

Alloy H-951 is similar to alloy H-963 but silicon is reduced and aluminum increased for almost the same total silicon plus aluminum content. These two alloys strongly indicate that small amounts of calcium, rare earth elements and, possibly zirconium and/or boron, all would provide enhanced room temperature elongations.

Alloy H-942 contains a small amount of boron but is an example of how a carbon content above about 0.35% in alloys of the invention results in reduced elongation values, even though the alloys possess high hot strengths.

Small additions of zirconium and boron made to alloy H-953 to enhance ductility were unable to overcome the higher carbon content of alloy H-953 but should enhance hot strength. Also, alloy H-899 is of low carbon content and otherwise chemically similar to the first six alloys of Table IV, but has low room temperature ductility. This alloy also has excellent hot strength (as shown below) but the results indicate that small additions of calcium and/or rare earth elements should be included for best ductility, weldability and resistance to thermal fatigue and shock.

Alloy H-903 also demonstrated good hot strength and rupture life but contained no calcium or rare earth elements and does not fall entirely within the optimum element composition ranges for best ductility, fabricability, weldability and resistance to thermal shock or fatigue.

While the carbon content of alloy H-946 is very close to the range required for optimum ductility, and calcium and cerium (rare earths) are present, the high silicon content coupled with somewhat elevated carbon content results in slight reduction in cold ductility. Nonetheless, alloy H-946 demonstrates that good hot strengths are still achievable in alloys of the invention when silicon is on the high side and aluminum is virtually eliminated. Alloy H-945, not of the invention, had a 7.47% Si content and drastically reduced hot strength.

Alloys H-959, H-943 and H-954 are examples of alloys of the invention that combine maximum hot strengths with lowest elongations due to very high carbon contents.

EXAMPLE 2

Standard one quarter inch diameter test bars were machined from each of the available seven bars from each heat. These bars were then tested at elevated temperatures in air on standard creep frames of the cantilever load type.

Even though alloy manufacturers typically provide estimated stress values for service lives of 10,000 hours and 100,000 hours, it is not practical in alloy development work to conduct tests lasting up to a year or longer, and certainly not up to eleven years. However, it has been found that higher stresses resulting in rupture lives of several days to several weeks or months provide data that can be well correlated to lower stresses that give service lives of years of duration. While other parameters have been employed, the most commonly used relationship is that known as the Larson-Miller Parameter. The form used was:

$$S=(T+460)(\mathrm{LOG}_t+C)\times 10^{-3}$$

in which

S=rupture stress in psi t=rupture life in hours

T=temperature °F.

C=a constant

The best data correlation has been obtained when the value for C is determined statistically for a given alloy type. For the alloys of the invention as well as for the RA85H type, I have found excellent correlation when C is equal to 22. Accordingly, stress values at 1600° F. (871° C.), 1700° F. (927° C.), 1800° F. (982° C.), and 2000° F. were determined so that rupture would occur in periods of several days to a few weeks per test.

The results of these test are set forth in Tables V, VI, VII and VIII. The higher carbon alloys had to be subjected to much higher stress values to obtain reasonably short rupture test periods. The test results for alloys of the invention were then extrapolated to 10,000 hours rupture life estimated stresses, which are set forth in Table IX. While the values for carbon levels of 0.2 to 0.3% are in the most useful range for parts to be wrought or quenched, the higher carbon values provide very high strengths for applications not involving severe thermal shock. The values for the comparative alloys were taken from published manufacturers literature. The test data for the 85H alloy made for these test correlates excellently with the manufacturer's data.

TABLE V

| ALLOY DESIGNATION | HOURS TO FAILURE AT 1600° F. UNDER VARIOUS STRESSES — STRESS, PSI 5000 | 6000 | 7000 | 8000 |
|---|---|---|---|---|
| H-899 | 294.9 | 61.1 | — | — |
| H-903 | 187.0 | 24.2 | — | — |
| H-942 | 2445.4 | 639.5 | 176.8 | — |
| H-943 | — | 1955.5 | 639.4 | — |
| H-944 | 482.3 | 123.7 | — | — |
| H-946 | 365.7 | 58.4 | — | — |
| H-947 | 945.6 | 386.8 | — | — |
| H-949 | 1148.7 | 327.3 | — | — |
| H-951 | 205.3 | 37.9 | — | — |
| H-953 | — | 1250.5 | 432.4 | — |
| H-954 | — | — | 1250.5 | 408.9 |
| H-959 | — | 1118.3 | 498.9 | — |
| H-960 | 317.2 | — | — | — |
| H-961 | 202.1 | — | — | — |
| H-962 | 345.8 | 80.8 | — | |
| H-963 | 311.2 | 76.3 | — | — |
| H-964 | 449.5 | — | — | — |
| 85H | 63.9 | 26.1 | — | — |
| 309 | 37.6 | — | — | — |
| 310 | 8.8 | — | — | — |
| 330 | 29.2 | — | — | — |
| H-945 | 83.6 | 10.2 | — | — |
| H-948 | 76.4 | 28.8 | — | — |
| H-950 | 119.6 | 42.1 | — | — |
| H-957 | 125.7 | 44.4 | — | — |
| H-958 | 68.9 | 24.3 | — | — |
| 1552C | 1.1 | — | — | — |
| 1553C | 14.3 | — | — | — |
| 1551C | 0.2 | — | — | — |

TABLE VI

| ALLOY DESIGNATION | HOURS TO FAILURE A 1700° F. UNDER VARIOUS STRESSES — STRESS, PSI 3000 | 3500 | 5000 | 6000 |
|---|---|---|---|---|
| H-899 | 1376.9 | 387.7 | — | — |
| H-903 | 1200.3 | 286.1 | — | — |
| H-942 | — | 3062.7 | — | — |
| H-943 | — | — | 530.8 | — |
| H-944 | 1496.5 | 521.9 | — | — |
| H-946 | 1615.5 | 500.5 | — | — |
| H-947 | 2753.1 | 808.2 | — | — |
| H-949 | 3790.6 | 1237.6 | — | — |
| H-951 | 1182.5 | 244.3 | — | — |
| H-953 | — | 1704.0 | — | — |
| H-954 | — | — | 1452.2 | 309.6 |
| H-959 | — | — | 426.2 | — |
| H-960 | 1283.2 | 369.8 | — | — |
| H-961 | 1249.5 | 331.9 | — | — |
| H-962 | 1415.6 | 404.1 | — | — |
| H-963 | 1325.1 | 329.6 | — | — |
| H-964 | 1874.2 | 421.3 | — | — |
| 85H | 77.4 | 29.7 | — | — |
| 309 | 44.8 | 20.1 | — | — |
| 310 | 6.9 | — | — | — |
| 330 | 23.6 | — | — | — |
| H-945 | 163.2 | 66.0 | — | — |
| H-948 | 344.4 | 96.9 | — | — |
| H-950 | 622.0 | 175.1 | — | — |
| H-957 | 871.4 | 245.4 | — | — |
| H-958 | 266.9 | 75.1 | — | — |
| 1552C | 5.7 | — | — | — |
| 1553C | 31.3 | — | — | — |
| 1551C | 0.3 | — | — | — |

TABLE VII

| ALLOY DESIGNATION | HOURS TO FAILURE AT 1800° F. UNDER VARIOUS STRESSES — STRESS, PSI 2000 | 2500 | 3000 | 3500 |
|---|---|---|---|---|
| H-899 | 1842.8 | 604.2 | — | — |

TABLE VII-continued

| ALLOY DESIGNATION | HOURS TO FAILURE AT 1800° F. UNDER VARIOUS STRESSES — STRESS, PSI 2000 | 2500 | 3000 | 3500 |
|---|---|---|---|---|
| H-903 | 750.3 | 216.9 | — | — |
| H-942 | — | 1842.8 | 903.7 | — |
| H-943 | — | — | 1428.5 | 571.0 |
| H-944 | 1820.6 | — | — | — |
| H-946 | 1842.8 | 465.7 | — | — |
| H-947 | 2770.1 | 875.2 | — | — |
| H-949 | 3227.4 | — | — | 970.5 |
| H-951 | 688.1 | 197.8 | — | — |
| H-953 | — | 1107.3 | 226.1 | — |
| H-954 | — | — | — | 950.3 |
| H-959 | — | — | 1052.2 | 361.0 |
| H-960 | 982.8 | — | — | — |
| H-961 | 842.6 | — | — | — |
| H-962 | 1742.8 | 490.1 | — | — |
| H-963 | 1625.6 | 388.3 | — | — |
| H-964 | 2142.6 | 544.3 | — | — |
| 85H | 166.4 | 58.3 | — | — |
| 309 | 35.0 | — | — | — |
| 310 | 5.8 | — | — | — |
| 330 | 19.1 | — | — | — |
| H-945 | 240.2 | 49.5 | — | — |
| H-948 | 321.9 | 76.8 | — | — |
| H-950 | 486.1 | 119.3 | — | — |
| H-957 | 553.8 | 131.9 | — | — |
| H-958 | 214.6 | 51.1 | — | — |
| 1552C | 4.8 | — | — | — |
| 1553C | 32.9 | — | — | — |
| 1551C | 1.1 | — | — | — |

TABLE VIII

| ALLOY DESIGNATION | HOURS TO FAILURE AT 2000° F. UNDER VARIOUS STRESSES — STRESS, PSI 1000 | 1500 | 3000 |
|---|---|---|---|
| H-899 | 213.4 | — | — |
| H-903 | 161.2 | — | — |
| H-942 | 910.6 | — | — |
| H-943 | 1455.8 | 357.1 | — |
| H-944 | 426.8 | — | — |
| H-946 | 357.1 | — | — |
| H-947 | 570.3 | — | — |
| H-949 | 519.3 | — | — |
| H-951 | 165.4 | — | — |
| H-953 | 755.1 | 121.7 | — |
| H-954 | — | 687.6 | 185.4 |
| H-959 | 1430.7 | 340.8 | — |
| H-960 | 190.1 | — | — |
| H-961 | 205.7 | — | — |
| H-962 | 370.7 | — | — |
| H-963 | 366.2 | — | — |
| H-964 | 440.1 | — | — |
| 85H | 48.5 | — | — |
| 309 | 11.2 | — | — |
| 310 | 7.3 | — | — |
| 330 | 7.4 | — | — |
| H-945 | 54.9 | — | — |
| H-948 | 81.2 | — | — |
| H-950 | 113.8 | — | — |
| H-957 | 140.1 | — | — |
| H-958 | 77.9 | — | — |
| 1552C | 3.5 | — | — |
| 1553C | 11.7 | — | — |
| 1551C | 0.4 | — | — |

Using the Larson-Miller Parameter, as described above, 10,000 hour stress values were calculated. These calculated data, which are approximate values but are useful for comparison purposes, are set forth in Table IX below. The alloys of the invention at about 0.2% C level are very much stronger than the 85H type alloys at temperatures above 1200° F., while both alloys far exceed the other three wrought comparative types above 1200° F.

TABLE IX

| TEMP. | STRESS (PSI) TO PRODUCE RUPTURE IN 10,000 HOURS | | | | | | | |
|---|---|---|---|---|---|---|---|---|
| | ALLOYS OF THE INVENTION | | | | RA85H | 309 | 310 | 330 |
| °F. | 0.2% C. | 0.3% C. | 0.4% C. | 1.2% C. | 0.2% C. | 0.17% C. | 0.07% C. | 0.05% C. |
| 1200 | 14,000 | 18,000 | 21,000 | — | 13,400 | 14,800 | 8,000 | 11,000 |
| 1400 | 6,300 | 7,600 | 8,800 | 13,500 | 5,200 | 4,900 | 2,500 | 4,300 |
| 1600 | 3,000 | 3,600 | 4,100 | 5,800 | 2,300 | 1,700 | 1,200 | 1,700 |
| 1800 | 1,300 | 1,600 | 2,000 | 2,400 | 800 | 550 | 540 | 630 |
| 2000 | 500 | 550 | 600 | 720 | 430 | 230 | 250 | 230 |

Several of the alloys of the invention all contain 0.20 to 0.25% C, but the total content of the special strengthening additive elements molybdenum, tungsten, columbium, titanium, zirconium and boron of alloy H-903 is at least 1% higher than those of the other alloys of similar carbon contents. However, the rupture lives of the other alloys within this carbon range exceed those of H-903. The effect of overly high total content of special elements is apparent.

Also, alloy H-961, with the slightly lower carbon content (0.16% C), still exceeded alloy H-903 in rupture life at all temperatures. It thus appears that, at least in the ideal carbon range of the alloys of the invention, there is no further gain in rupture life obtained by almost doubling the total content of the special strengthening elements.

Up to as much as 1% B has been used to greatly increase the rupture lives of some nickel-cobalt-chromium-base heat resistant alloys. However, I have found in iron base-alloys that optimum rupture life may be achieved at much lower boron levels and that further increases serve to reduce rupture life below the optimum levels. In many prior commercial iron-base heat resistant alloys boron has been employed at levels from about 0.003% to about 0.06%. It appears from the work so far with alloys of the invention that boron content should be restricted to no more than about 0.1%.

EXAMPLE 3

Both silicon and aluminum have been found to inhibit the carburization process, and they have also been known to greatly increase the resistance of alloys to hot gas corrosion. The silicon and aluminum contents of the alloys of the invention enable them to resist severe oxidation at temperatures in the 2000° to 2200° F. range, whereas such alloys would begin to oxidize and scale severely in the 1650° to 1800° F. temperature range without the high total content of these two elements.

All test bars were examined after exposure at the various temperatures. Even those test bars of the invention that were exposed to 1800° and 2000° F. had thin, tightly adherent surface oxide coatings. Test bars of similar composition but lacking the high silicon and optional aluminum contents of the alloys of the invention show loose, easily peeled oxide coatings of about 0.012 inches thickness after as little as 30 hours exposure at 1800° to 2000° F. in these test units. The high silicon plus aluminum contents are obviously providing a high level of oxidation resistance.

Post, et al., U.S. Pat. No. 2,553,330, claims greatly enhanced workability of an extremely wide variety of alloys brought about by additions of 8 to 12 pound of misch metal, cerium or some combination of rare earth metals, per ton of alloy. Other workers in the field have reported greatly enhanced resistance to high temperature oxidation of numerous alloys brought about by similar additions of cerium or some combination of rare earth metals. Still others have reported desulfurization and other improvements of alloy properties by similar additions. Such additions are equivalent to 6.4 to 9.6 ounces per hundred pounds of alloy melt. Additions of 8 ounces per hundred pounds of melt were made to several of the experimental alloys of the present invention to determine if such additions would be useful or would be detrimental to their hot strengths or oxidation resistance. These additions were found to not be detrimental. There were also indications that the addition of misch metal was beneficial to either normal or high sulfur alloys of the invention by increasing room temperature ductility and improving scale resistance over that otherwise expected from a given chromium, silicon and aluminum combination.

EXAMPLE 4

All test bars of the alloys of the invention were tested before and after exposure to high temperature for magnetic permeability, and all measured less than 1.02 gauses per oersted, that is, they had virtually no measurable magnetic permeabilities. Inasmuch as ferrite is a ferromagnetic phase at or near room temperature, this test indicated that no measurable quantity of ferrite was present in the alloys of the invention either before or after high temperature exposure.

Sigma phase is most readily formed in susceptible heat resistant alloys by exposure at about 1600° F. Therefore, the test bar of each alloy of the invention that that been exposed for the longest period of 1600° F. was sectioned, polished, etched and examined under a high power microscope for the presence of sigma phase. No sigma phase was observed in any of the samples.

From the forgoing examples it is evident that alloys of the invention have much higher hot strengths than those of the RA85H type alloys whether the instant alloys contain high silicon and aluminum contents or only high silicon content, provided the total of the content of both elements does not exceed about 6.6% by weight. The results further demonstrate that such high hot strengths are developed by the addition of very small amounts of molybdenum, tungsten, columbium and titanium, with further enhancement of many properties obtained by the addition (optional) of extremely tiny amounts of one or more elements from the group, zirconium, boron, calcium and rare earth elements.

The best cold ductility values, that are characteristic of highest resistance to thermal shock and best weldability, are found in alloys of the invention containing less than about 0.35% carbon. A careful, detailed analysis of the stress rupture data reveals that, at all temperatures, the highest rate of increase in hot strengths with increasing carbon contents is observed in the range of about 0.15 to 0.35% carbon. It is further evident that manganese contents up to at least 3.5% do not have deleterious effects upon either the hot strengths or ductilities of alloys of the invention.

A total content of about 1.2% to 1.4% of the four elements molybdenum, tungsten, columbium and titanium seems to provide optimum overall room temperature and high temperature properties for alloys of the invention containing about 0.2% to about 0.4% C.

The comparative alloys 1552C, 1553C and 1551C were formulated by adding about 0.2% C to the types of high silicon corrosion resistant alloys disclosed in British Patent No. 1,534,926. They had very short rupture lives with the lowest stress loads of the tests at each temperature. Alloy 1553C was the best of the three and quite similar to comparative alloy 85H and inventive alloy H-960 except for its higher nickel and silicon contents and absence of additions of molybdenum, tungsten, columbium, titanium or other elements. Since alloys 1553C and 85H both lack the special elements of the invention, they have very short rupture lives. The somewhat higher silicon content of alloy 1553C over alloy 85H shows further deterioration of hot strength with increasing silicon in alloys not of the invention. However, the inventive alloys of much higher silicon contents than alloy 1553C, either with or without aluminum addition, have much higher hot strengths and rupture lives than either alloy 85H or 1553C.

It is also evident that with the addition of typically less than 1.5% total content of the addition elements, molybdenum, tungsten, columbium, titanium and optionally, zirconium, boron, calcium and rare earth elements, a remarkable increase in high temperature properties was obtained as compared to the same alloy types without such additions. At the same carbon level as the H85 type alloys, alloys of the invention typically developed rupture strengths of about 30% to 50% above those of the base alloy for the same service life or offered about 3 to 8 times the service life expectancy at the same stress level.

The foregoing description of the several embodiments of the invention is not intended as limiting of the invention. As will be apparent to those skilled in the art, variations and modifications of the invention may be made without departure from the spirit and scope of this invention.

What is claimed is:

1. An alloy consisting essentially of, by weight:

| | |
|---|---|
| Nickel | about 10.5 to about 28% by weight |
| Chromium | about 14.8 to about 23% |
| Silicon | about 3 to about 6.6% |
| Aluminum | about 0 to about 4% |
| Silicon plus aluminum | about 3 to about 6.6% |
| Molybdenum | about 0.15 to about 1.6% |
| Tungsten | about 0.25 to about 1.25% |
| Columbium | about 0.10 to about 0.75% |
| Titanium | about 0.05 to about 0.45% |
| Carbon | about 0.12 to about 1.2% |
| Manganese | about 0.2 to about 4% |
| Iron | essentially balance. |

2. An alloy of claim 1 further containing:

| | |
|---|---|
| Calcium | up to about 0.1% by weight |
| Zirconium | up to about 0.25% |
| Boron | up to about 0.1% |
| Nitrogen | up to about 0.3% |
| Rare earths | up to about 0.15% |

3. An alloy of claim 2 containing:

| | |
|---|---|
| Nickel | about 10.5 to about 22% by weight |
| Chromium | about 14.8 to about 22% |
| Silicon | about 3 to about 6.6% |
| Aluminum | about 0 to about 3% |
| Silicon plus aluminum | about 3.5 to about 6.6% |
| Molybdenum | about 0.15 to about 1% |
| Tungsten | about 0.25 to about 1% |
| Columbium | about 0.10 to about 0.55% |
| Titanium | about 0.05 to about 0.35% |
| Carbon | about 0.15 to about 0.9% |
| Manganese | about 0.5 to about 4% |
| Zirconium | up to about 0.2% |
| Boron | up to about 0.1% |
| Nitrogen | up to about 0.3% |
| Rare earths | up to about 0.15% |
| Calcium | up to about 0.1% |
| Iron | essentially balance. |

4. An alloy of claim 3 containing:

| | |
|---|---|
| Nickel | about 10.5 to about 16% by weight |
| Chromium | about 14.8 to about 20% |
| Silicon | about 3 to 5.6% |
| Aluminum | about 0 to about 2% |
| Silicon plus aluminum | about 4.4 to about 5.6% |
| Molybdenum | about 0.18 to about 0.55% |
| Tungsten | about 0.20 to about 0.65% |
| Columbium | about 0.20 to about 0.40% |
| Titanium | about 0.10 to about 0.35% |
| Carbon | about 0.15 to about 0.35% |
| Manganese | about 0.6 to about 3.5% |
| Zirconium | up to about 0.15% |
| Boron | up to about 0.05% |
| Nitrogen | up to about 0.15% |
| Rare earths | up to about 0.12% |
| Calcium | about 0.002 to about 0.1% |
| Iron | essentially balance. |

5. An alloy of claim 4 wherein the proportion of carbon is in the range of about 0.15% to about 0.30%.

6. An alloy of claim 2, wherein the proportion of carbon is in the range of about 0.15% to about 0.35%.

7. An alloy of claim 2 wherein the proportion of carbon is in the range of about 0.30% to about 0.55%.

8. An alloy of claim 2 wherein the proportion of carbon is in the range of about 0.55% to about 1.2%.

9. An alloy of claim 7 wherein the proportion of rare earths is up to about 0.12%.

10. An alloy of claim 2 wherein the proportion of carbon is in the range of about 0.2% to about 0.4% and the proportion of the sum of molybdenum, tungsten, columbium and titanium is in the range of about 1.2% to about 1.4%.

11. An alloy consisting essentially of:

| | |
|---|---|
| Nickel | about 11.0% by weight |
| Chromium | about 15.4% |
| Silicon | about 4.61% |
| Aluminum | about 0.09% |
| Molybdenum | about 0.28% |
| Tungsten | about 0.48% |
| Columbium | about 0.31% |
| Titanium | about 0.23% |
| Carbon | about 0.28% |
| Manganese | about 2.29% |
| Iron | essentially balance. |

12. An alloy consisting essentially of:

| | |
|---|---|
| Nickel | about 12.9% by weight |
| Chromium | about 15.2% |
| Silicon | about 4.62% |

-continued

| | |
|---|---|
| Aluminum | about 0.21% |
| Molybdenum | about 0.26% |
| Tungsten | about 0.40% |
| Columbium | about 0.29% |

-continued

| | |
|---|---|
| Titanium | about 0.22% |
| Carbon | about 0.25% |
| Manganese | about 2.31% |
| Iron | essentially balance. |

* * * * *